US009789018B2

(12) United States Patent
Anderson et al.

(10) Patent No.: US 9,789,018 B2
(45) Date of Patent: Oct. 17, 2017

(54) CUSHION FOR SEATING

(71) Applicant: Otto Bock HealthCare LP, Minneapolis, MN (US)

(72) Inventors: Vaughn R. Anderson, Highland, UT (US); Evan W. Call, Bountiful, UT (US); Darshan P. Rane, Salt Lake City, UT (US)

(73) Assignee: OTTO BOCK HEALTHCARE LP, Minneapolis, MN (US)

( * ) Notice: Subject to any disclaimer, the term of this patent is extended or adjusted under 35 U.S.C. 154(b) by 555 days.

(21) Appl. No.: 14/067,742

(22) Filed: Oct. 30, 2013

(65) Prior Publication Data

US 2015/0113735 A1 Apr. 30, 2015

(51) Int. Cl.

| | |
|---|---|
| ***B68G 5/00*** | (2006.01) |
| ***A47C 16/00*** | (2006.01) |
| ***A61G 5/10*** | (2006.01) |
| ***A61G 7/057*** | (2006.01) |
| ***A47C 7/02*** | (2006.01) |
| ***A47C 27/14*** | (2006.01) |
| ***A47C 27/18*** | (2006.01) |

(52) U.S. Cl.

CPC ..... *A61G 5/1043* (2013.01); *A47C 7/021* (2013.01); *A47C 27/142* (2013.01); *A47C 27/18* (2013.01); *A61G 5/1045* (2016.11); *A61G 7/05769* (2013.01); *A61G 7/05715* (2013.01); *Y10T 29/49826* (2015.01)

(58) Field of Classification Search

CPC ..... A61G 5/1043; A61G 7/05769; A61G 7/05715; A61G 2005/1045; A47C 7/021; A47C 27/142; A47C 27/18

See application file for complete search history.

(56) References Cited

U.S. PATENT DOCUMENTS

| | | | | |
|---|---|---|---|---|
| 4,803,744 A | | 2/1989 | Peck et al. | |
| 5,176,424 A | | 1/1993 | Tobita et al. | |
| 5,369,828 A | * | 12/1994 | Graebe | A47C 4/54 297/452.41 |
| 5,379,471 A | * | 1/1995 | Holdredge | A61G 5/1043 297/DIG. 8 |
| 5,561,875 A | * | 10/1996 | Graebe | A61G 5/1043 297/180.13 |
| 5,689,845 A | * | 11/1997 | Sobieralski | A61G 7/05769 297/452.41 |
| 5,701,621 A | | 12/1997 | Landi et al. | |

(Continued)

OTHER PUBLICATIONS

International Search Report for PCT International Application No. PCT/US2014/060443, mailed Dec. 23, 2014 (4 pp.).

(Continued)

*Primary Examiner* — David E Sosnowski

(74) *Attorney, Agent, or Firm* — Holland & Hart LLP

(57) ABSTRACT

A hybrid seating cushion made up of a cushion base and a cushion insert. The cushion base has a seating surface in which a void in or extending through the cushion base is formed. A cushion insert such as an air bladder or fluid sack is positioned within the void. A lip or upper surface around an opening in the void overhangs at least a portion of the cushion insert, thereby minimizing the size and corresponding negative effects of a transition area where the base and the insert overlap.

6 Claims, 7 Drawing Sheets

(56) References Cited

U.S. PATENT DOCUMENTS 5,845,352 A * 12/1998 Matsler ..... A47C 7/021 297/452.41
6,018,832 A * 2/2000 Graebe ..... A47C 7/022 5/652
6,598,251 B2 * 7/2003 Habboub ..... B60N 2/56 297/452.42
6,868,569 B2 * 3/2005 VanSteenburg ..... A47C 27/081 5/709
6,901,617 B2 * 6/2005 Sprouse, II ..... A47C 4/54 297/219.1
7,617,555 B2 * 11/2009 Romano ..... A47C 27/122 5/714
8,584,286 B2 * 11/2013 Call ..... A47C 7/021 5/654
8,915,339 B2 * 12/2014 Kanous ..... A47C 27/18 188/377
2003/0030319 A1 * 2/2003 Clapper ..... A47C 4/54 297/452.41
2003/0061663 A1 * 4/2003 Lampel ..... A47C 27/146 5/653
2003/0205920 A1 * 11/2003 Sprouse, II ..... A47C 4/54 297/219.1
2005/0120483 A1 * 6/2005 Clapper ..... A47C 7/021 5/654
2005/0151410 A1 7/2005 Sprouse, II
2006/0064820 A1 * 3/2006 Call ..... A61G 5/1043 5/654
2007/0056112 A1 * 3/2007 Graebe ..... A47C 4/54 5/655.3
2011/0041250 A1 * 2/2011 Satou ..... A61G 5/1043 5/654
2014/0020185 A1 * 1/2014 Wang ..... A47C 7/021 5/652.1
2014/0020186 A1 * 1/2014 Fan ..... A61G 5/10 5/654
2014/0130264 A1 * 5/2014 Misaki ..... A47C 27/10 5/713

OTHER PUBLICATIONS

European Office Action in Application No. 14790938.6, dated Mar. 1 2017 (5 pp.).

* cited by examiner

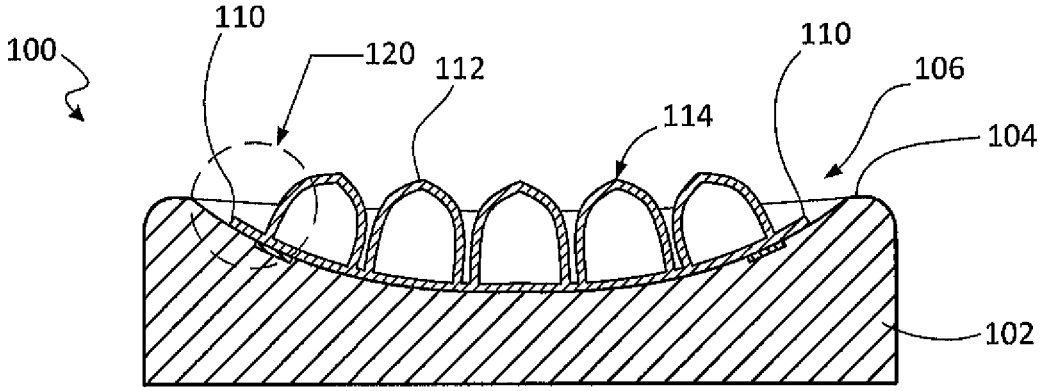
FIGURE 1A --Prior Art--
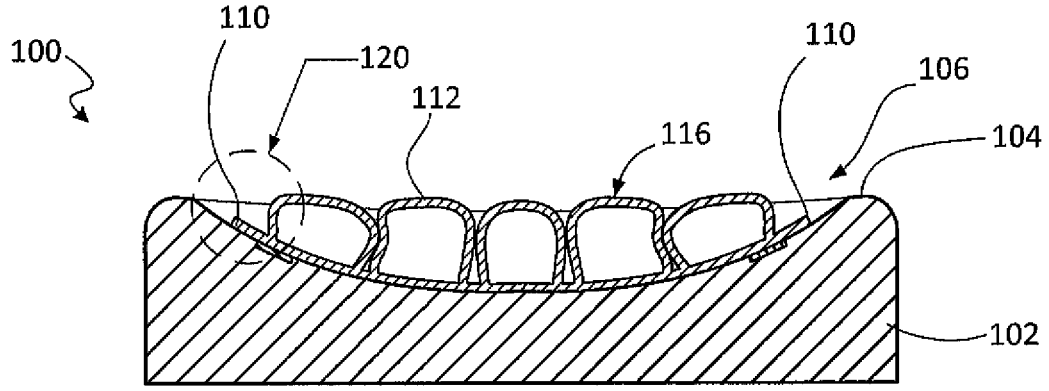
FIGURE 1B --Prior Art--
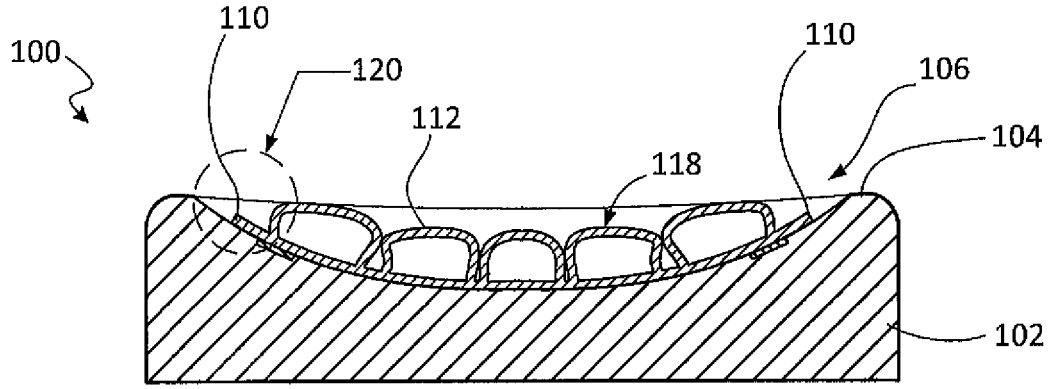
FIGURE 1C --Prior Art--

CUSHION FOR SEATING

TECHNICAL FIELD

The present disclosure relates generally to seat cushions, and particularly relates to seat cushions of the type commonly used with wheelchairs.

BACKGROUND

Wheelchair users who spend a large portion of their day seated in a wheelchair are at risk of developing pressure ulcers (i.e., skin tissue breakdown) in their buttocks region. Pressure ulcers tend to occur in skin tissue that contacts the seat cushion near the bony prominences of the hip. Regions most prone to developing pressure ulcers include skin surrounding the ischial tuberosities, coccyx, and sacral area. A disabled wheelchair user, particularly one with partial or complete paralysis, is more likely to develop pressure ulcers because he or she lacks supportive muscular tissue that surrounds and protects the bony prominences of the buttocks. This problem is compounded by poor circulation and an inability to reposition during seating. Pressure ulcers cause severe discomfort and may pose a serious health risk to the wheelchair user.

Attempts have been made to provide wheelchair seating that reduces the likelihood of pressure ulcers. Seat cushions have been developed in an effort to eliminate pressure hotspots (i.e., a center of high pressure within a larger area of relatively low pressure) by pressure redistribution at the bony prominences in contact with a cushion.

One family of cushions uses a fluid membrane sack in conjunction with a foam cushion base as a means of supporting the user. The fluid membrane sack, which contains a gel or liquid-like substance, is intended to support the buttocks under hydrostatic (or otherwise generally evenly distributed) pressure. The fluid is typically contained within one or more thin pliable membrane sacks. The fluid is permitted to flow around the contour of the buttocks, with the bony prominences supported by the fluid, so that the entire region supported by the fluid experiences substantially the same level of pressure.

Another family of cushions uses an air-cell bladder in concert with a foam cushion base as a means of supporting the user. The air-cell bladder is intended to support the buttocks by evenly distributing air pressure in the air-cells in much the same way as with the fluid membrane sack.

One limitation to the efficacy of both of these families of cushions is the transition zone that exists at the region in which the bladder/sack and the foam base converge. When two different materials are used in a cushion, and more particularly on the seating surface of the cushion, the points wherein these two materials come in contact with each other or are attached to each other create a transition area. Generally, the physical properties of these two materials are significantly different in the transition areas and the performance and comfort of the cushion is reduced. When the user sits on a cushion, the cushion base and cushion insert both compress, but, due to the difference in physical properties that exist between the cushion base and cushion insert, they compress differently and produce uncomfortable differences in pressure on the user's body.

Current cushions focus on either the type of pressure relieving mediums (gel, fluids, air) or the types and shapes of the cushion foam base.

SUMMARY

One aspect of the present disclosure relates to a hybrid seating cushion made up of at least a cushion base and a bladder. The cushion base may have a seating surface. The seating surface may have a lip edge overhanging a void in the cushion base. The bladder may be positioned in the void and may have an outer wall extending at least partially under the lip edge.

In some embodiments, the bladder may be made of a plurality of at least partially separate cells. These cells may be interconnected by a plurality of pressure-distributing passages. When a user is seated on the seating surface, the bladder may be configured to support an ischial tuberosity, a coccyx, and/or a sacral area of the user. In some arrangements, the lip edge of the cushion is pointed inward in relation to an opening of the void. The lip edge may also at least partially form a transition surface between a sidewall of the void and the seating surface.

In another embodiment, a hybrid seating cushion is provided that may be made of a cushion base and a bladder. The cushion base may include a seating surface and a void formed at least in part by an interior sidewall of the cushion base. The void may be accessible at or along the seating surface. The bladder may be positioned within the void. An interior sidewall of the cushion base void may extend over at least a portion of an outer wall of the bladder, such as when the bladder is positioned in the void.

In some configurations, the seating surface and the sidewall of the cushion base may intersect at an angle of less than 90 degrees. The sidewall may be concave shaped. An outer wall of the bladder may be at least partially sloped, and at least a portion of the sloped outer wall of the bladder may be positioned under the interior sidewall of the cushion base.

In some embodiments, the void extends completely through the cushion base from the seating surface to an oppositely-positioned bottom surface, but in other embodiments the void extends partially through a thickness of the cushion base.

In some cases, when the seating surface is under vertical compression at least a portion of the interior sidewall of the cushion base may overlap at least a portion of the outer wall of the bladder. In other cases, when the seating surface is under compression at least a portion of the interior sidewall of the cushion base may be pressed into contact with at least a portion of the outer wall of the bladder.

In yet another embodiment, a hybrid seating cushion is disclosed which includes a cushion base and a bladder. The cushion base may include a seating surface and void in seating surface, wherein the void may have a side wall. The intersection of the seating surface and the side wall may form an angle of less than 90 degrees. The bladder may be positioned within the void. When a user is seated on the seating surface, a transition area between the cushion base and the bladder may be filled with at least a portion of the cushion base and at least a portion of the bladder.

In some of these embodiments, the seating surface and the side wall may intersect at an angle between about 70 degrees and about 90 degrees.

In some arrangements where a user is seated on the seating surface, at least a portion of the cushion base fills the transition area between the user and the at least a portion of the bladder. In some embodiments, the bladder may be positioned within the void by attachment of the bladder to a lower surface of the cushion base, such as a surface of the cushion base below the seating surface.

In another embodiment, a method of manufacturing a hybrid seating cushion is disclosed. The method may include the steps of providing a cushion base and a bladder, wherein the cushion base has a seating surface and the bladder has an outer wall; forming a void in the seating surface, wherein the void has a lip edge and is sized to receive the bladder; and positioning a bladder within the void, wherein at least a portion of the outer wall of the bladder is positioned under the lip edge of the cushion base.

In some embodiments of the method, the fill level of a fluid within the bladder may be adjusted. This may entail attaching the bladder to a lower surface of the cushion base, such as a surface of the cushion base below the seating surface. The step of providing the bladder may additionally include providing a plurality of at least partially separate cells in the bladder. The step of forming the void may additionally include forming an interior sidewall in the void, wherein a plane of the interior sidewall and a plane of the seating surface are formed to intersect at an angle of less than 90 degrees. The step of forming the void may additionally include forming the void to extend partially or completely through the cushion base.

The foregoing and other features, utilities, and advantages of various embodiments will be apparent from the following detailed description and with reference to the accompanying drawings.

BRIEF DESCRIPTION OF THE DRAWINGS

The accompanying drawings illustrate various embodiments of the principles described herein and are a part of the specification. Together with the following description, the drawings demonstrate and explain the principles of the exemplary system and method. The illustrated embodiments are merely examples and do not limit the scope of the disclosure.

FIG. 1A is a cross-section view of a seating cushion and a filled bladder portion according to an embodiment in the prior art.

FIG. 1B is a cross-section view of a seating cushion and partially-emptied bladder portion according to an embodiment in the prior art.

FIG. 1C is a cross-section view of a seating cushion and significantly-emptied bladder portion according to an embodiment in the prior art.

Throughout the drawings, identical reference numbers designate similar, though not necessarily identical, elements.

DETAILED DESCRIPTION

Figure 2:
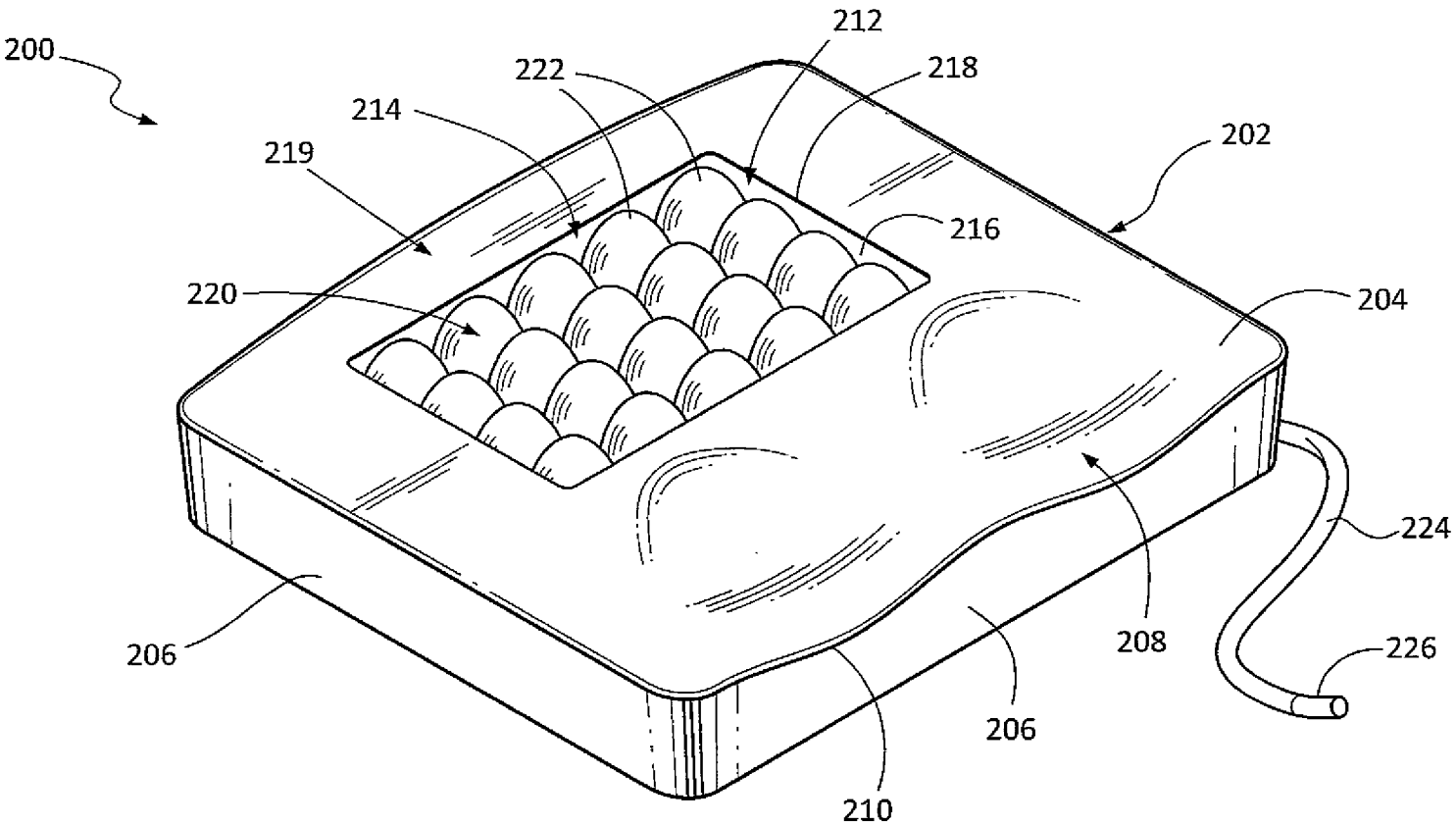
FIG. 2 is a perspective view of a hybrid cushion for seating according to an embodiment of the present disclosure.

The present disclosure is directed to cushions for seating and related methods. An example application is a cushion base that may be used for a seat in a wheelchair. For instance, the cushion for seating may include a seating surface with a void having an inset fluid bladder system. One feature of certain embodiments described herein shows that to obtain optimal cushion performance, the transition area may be eliminated or reduced to an insignificant size, thereby reducing or eliminating pressure concentrations on the user's body resulting from the transition area.

The sides of the void in the cushion may be formed so that when a user is seated on the seating surface, the sides are urged toward the outer portions of the bladder system and fill the transition area between the different materials. As a result, the user may have a more comfortable seating surface due to optimal cushion performance at the transition area. Accordingly, the present disclosure may eliminate the adverse effects that exist in cushion and seating systems that are constructed with at least two different mediums or materials in the cushion base.

As used herein, an "aperture" may refer to a space within a material or outer body. The aperture may be bounded by an outside perimeter of the material such as sidewalls of a through-hole or tunnel passing through the material. An aperture may therefore be interchangeably referred to as a "through-hole" or "hole" in a material.

As used herein, a "cavity" may refer to a space in a material that does not pass through the material completely. For example, a cavity may be a space in a material that does not have two open ends, but the space may have an open end and a closed end. In another example, a cavity may be a space bounded on its sides and bottom by the material and has one or more openings at one surface or side of the material.

As used herein, a "void" may refer generally to an aperture, a cavity, or both within a material or outer body. An "indentation" is a shallow cavity in the material. For example, the bottom surface of an indentation (i.e., the surface below an opening in the material) may be narrower or equal in width to its opening. The internal width of a void, aperture, or cavity may vary along its length or depth.

An "opening" refers to a space in a surface of a material, such as, for example, the entrance to or exit from a void in a material. An "opening" may alternatively refer generally to the aperture, cavity, or void of which the space in the surface is a part.

A void in the cushion may extend partially or completely through the cushion body. Typically, a void is formed in the cushion so as to be under the regions most prone to developing pressure ulcers, including skin surrounding the ischial tuberosities, coccyx, and sacral area. A cushion insert (e.g., a bladder or other fluid membrane sack) may be positioned in the void so that at least a portion of a side of the bladder is underneath a lip edge running along at least part of an opening at the seating surface of the cushion. When vertical pressure is applied to the seating surface, such as when a user is seated on the cushion, the pressure drives the lip edge downward toward the side of the bladder, thus either contacting the bladder or approaching the bladder and thereby greatly reducing the transition area by filling it with the lip and bladder. Thus, the user's buttocks region may be effectively supported by multiple cushion materials and by multiple cushion insert fill levels without the discomfort of a large transition area or exposed outer edge of a bladder touching his or her body.

In some embodiments, the sides void in the cushion are shaped to collapse toward the cushion insert due to being shaped to make an angle of less than 90 degrees with the seating surface. This reverse tapering of the side walls around the cushion insert may cause the side walls to flex downward and/or inward when under vertical pressure. Since the cushion insert is positioned inward or underneath the lip edge of the opening in the seating surface, the space between the insert and the cushion base decreases. In other embodiments, the side walls may be concaved, curved, or otherwise shaped to permit outer and/or peripheral portions of a bladder insert to lie under the edge of the seating surface.

The present disclosure illustrates a wheelchair cushion, but it is not limited to wheelchairs. Features of embodiments described herein may also be adapted to, without limitation, seating for cars, trucks, boats, trains, or motorcycles, as well as any furniture, portable cushions for seating, and all other cushion and seating applications.

To assist in illustrating functional and structural differences between prior art cushions and embodiments of the present disclosure, an illustrative cross-section view of a seating cushion and bladder portion is shown in FIGS. 1A-1C. The cushion base 102 has an upward-facing seating surface 104 in which an indentation 106 is formed. A multi-cellular bladder 114, 116, 118 is positioned or attached in the indentation 106 and provides a different level of support to a seated user in comparison to the cushion base 102. For example, the bladder 114, 116, 118 may be filled with air or a gel, and the cushion may be comprised of semi-rigid foam, such as Ethafoam or foam rubber. The outer edge 110 of the bladder 114, 116, 118 is exposed to a user seated on the seating surface 104 and a top surface 112 of the bladder.

When a user is seated on this hybrid cushion 100, the bladder 114, 116, 118 and cushion base 102 compress at different rates. The bladder 114, 116, 118 itself may be configurable to provide different levels of support, from a fully-filled bladder 114 shown in FIG. 1A, to a partially-emptied bladder 116 shown in FIG. 1B or an even more emptied bladder 118 shown in FIG. 1C. As indicated by the circled transition areas 120, the inflation level of a bladder 114, 116, 118 affects the size of the transition areas 120 between the seating surface 104 and the top surface 112 of the bladder 114, 116, 118.

The transition areas 120 are often a source of discomfort for users due to the presence of the edge 110 of the bladder 114, 116, 118, which in some cases may buckle or bend into ridges or ripples that come into contact with the user, thereby producing undesirable pressure concentrations, scratching, or pinching. Furthermore, the transition areas 120 may act as open spaces below the seating surface 104 and top surface 112 that allow portions of the user's skin to be unsupported or pinched by adjacent cushion and bladder portions, leading to uncomfortable seating and potentially hazardous skin conditions. While deflating the bladder 114, 116, 118 incrementally improves comfort by reducing the size of the transition areas 120 as shown in FIG. 1C, flexibility of the bladder 114, 116, 118 is simultaneously reduced, hindering the ability of the bladder 114, 116, 118 to displace and conform yet still support the user's body. Furthermore, the transition areas 120 are never fully eliminated, even after completely emptying the bladder.

Figure 3:
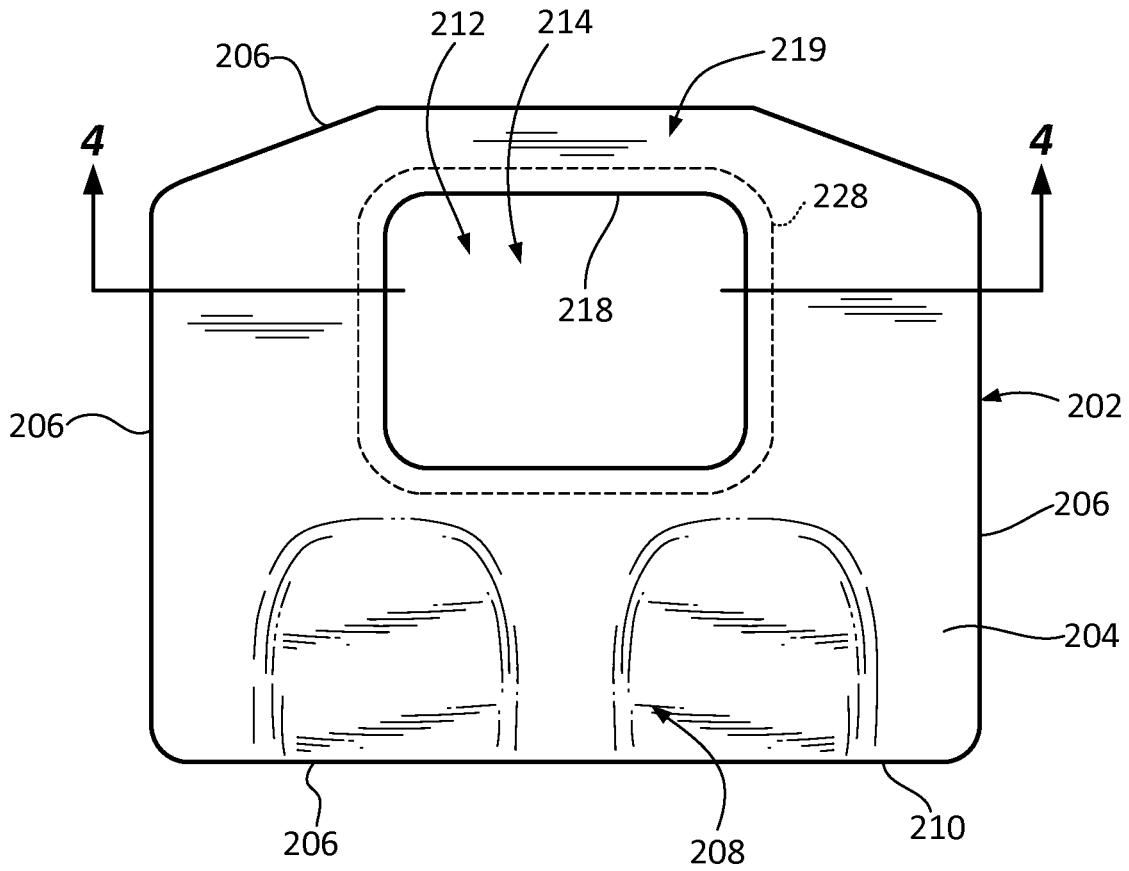
FIG. 3 is a top plan view of a cushion base for a hybrid cushion for seating according to an embodiment of the present disclosure.
Figure 4:
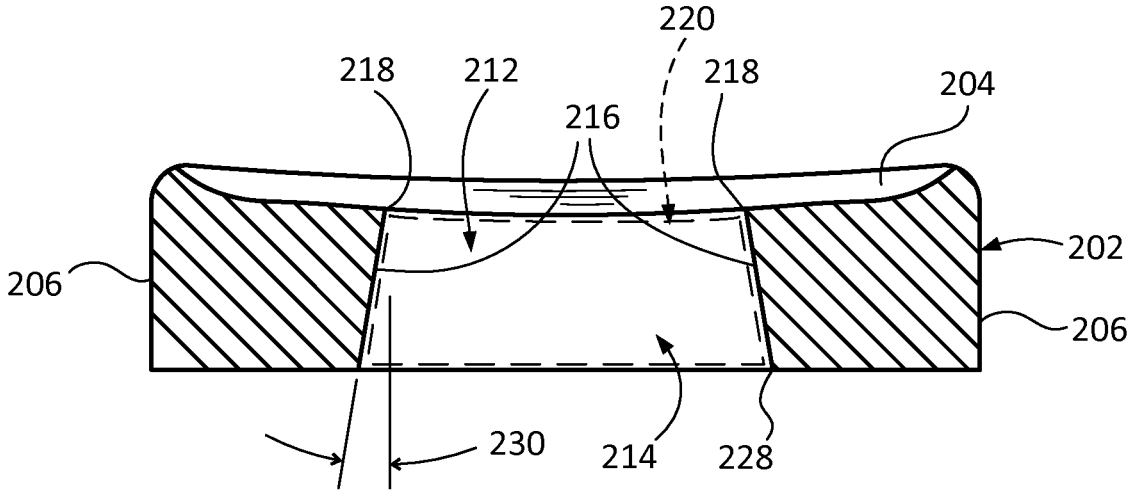
FIG. 4 is a cross-section view of the cushion base shown in FIG. 3 taken along cross-section indicators 4-4.

FIGS. 2-4 show various views of a hybrid cushion 200 and cushion base 202 according to an embodiment of the present disclosure. FIG. 2 is a perspective view of a hybrid cushion 200 including a cushion base 202. The cushion base 202 may have an upward-facing seating surface 204 and outer sides 206. The seating surface 204 may include a contoured region 208 to distribute pressure from a user's body (e.g., his or her upper leg areas) across the seating surface 204. The seating surface 204 may be tapered, curved, or rounded at a front edge 210. The contoured region 208 may be beneficially positioned on the front, sides, and back of the seating surface 204 so as to provide postural support and a reduction in peak pressures, for the user. This contour provides postural support as well as reduces peak pressures and hot spots on the cushion.

The cushion base 202 may comprise a soft foam material. For example, the cushion base 202 may comprise a flexible, soft material or medium capable of distributing weight of a seated user. Example materials for the cushion base 202 may include, for example and without limitation, a semi-rigid foam material made of natural or synthetic materials, such as polyurethane foam, latex foam rubber, viscoelastic foam, rest-suspended foam, reticulated polyurethane foam, lux foam, bonded foam, another foam rubber, cellular rubber, or an inflatable air or fluid bladder. The formation of the cushion base may include at least one material, but the cushion base may include multiple materials, including multiple foams. A semi-rigid foam may not flex into and fill the transition area. Thus, the cushion base may be an air bladder that is filled to a different pressure than the insert air bladder.

An opening 212 may be defined in the cushion base 202. For example, the opening 212 may be in the seating surface 204 and form a void 214 within the cushion base 202. The void 214 may have at least one sidewall 216 surface. The opening 212 may have a lip 218 running around at least a portion of the interface between the seating surface 204 and the sidewall 216. In some embodiments, the shape of the lip 218 may be a pointed edge running around one or more portions or sides of the opening 212 (see, e.g., FIG. 4). For example, the sidewall 216 and seating surface 204 may intersect to form a pointed lip 218. The lip 218 may be pointed inward to the opening 212, thereby making a portion of the void 214 below the lip 218 wider than the opening 212, as shown in FIG. 4. In some embodiments, the lip 218 edge may be rounded, filleted, chamfered or take another transition shape where the seating surface 204 meets the sidewall 216. Doing so may provide at least the benefit of a more gradual transition between the seating surface and an upper surface of a cushion insert 220. In some embodiments, the lip 218 may be formed as part of a transition surface or sidewall portion that may be substantially perpendicular to the seating surface 204, as described in further detail in connection with FIG. 7A.

The opening 212 may be advantageously positioned in the rear area 219 of the seating surface 204 of the cushion base 202 so as to be positioned under the user's ischial tuberosities, coccyx, and/or sacral area when the user is seated on the seating surface 204. Thus, with a cushion insert 220 or bladder in position in the opening 212 or void 214, those weight-bearing portions of the user's body may receive more comfortable support. In some embodiments, the opening 212 may be beneficially positioned elsewhere on the cushion, such as at a point of user-weight-bearing significance or at another point susceptible to development of ulcers or other pressure-related ailments.

A cushion insert 220 may be positioned in the void 214 of the hybrid cushion 200. The cushion insert 220 may include a resilient bladder filled with air, gel, a liquid, or another gas or fluid. In some configurations, the bladder may be sealed, but in other configurations it may be adjustably filled or emptied by a user. The bladder may be beneficially comprised of a polymer, neoprene rubber, natural or synthetic rubber, PVC, latex, or other flexible elastomeric material that allows flexible expansion and contraction of the bladder and permits the bladder to comfortably conform to and support the shape of a user seated on the hybrid cushion 200. The cushion insert 220 may comprise multiple partitions 222. The partitions may be separate from each other, but in some arrangements, at least some of the partitions may be in fluid communication with each other. For example, if the partitions 222 are in fluid communication with each other, air or another fluid or gel within the partitions 222 may redistribute among the partitions 222 to better distribute the weight borne by the cushion insert 220.

In some embodiments, the cushion insert 220 may further comprise a fill tube 224. The fill tube 224 may extend from the cushion insert 220 to an easily accessible outer area of the cushion base 202, such as one of the outer sides 206. The user may introduce or remove fill fluid for the cushion insert 220 through the fill tube 224, thereby managing or adjusting the amount of the material stored within the cushion insert 220. The end of the fill tube 224 may include a valve 226 operable to control the inflow and/or outflow of material from the cushion insert 220 through the fill tube 224.

Figure 8:
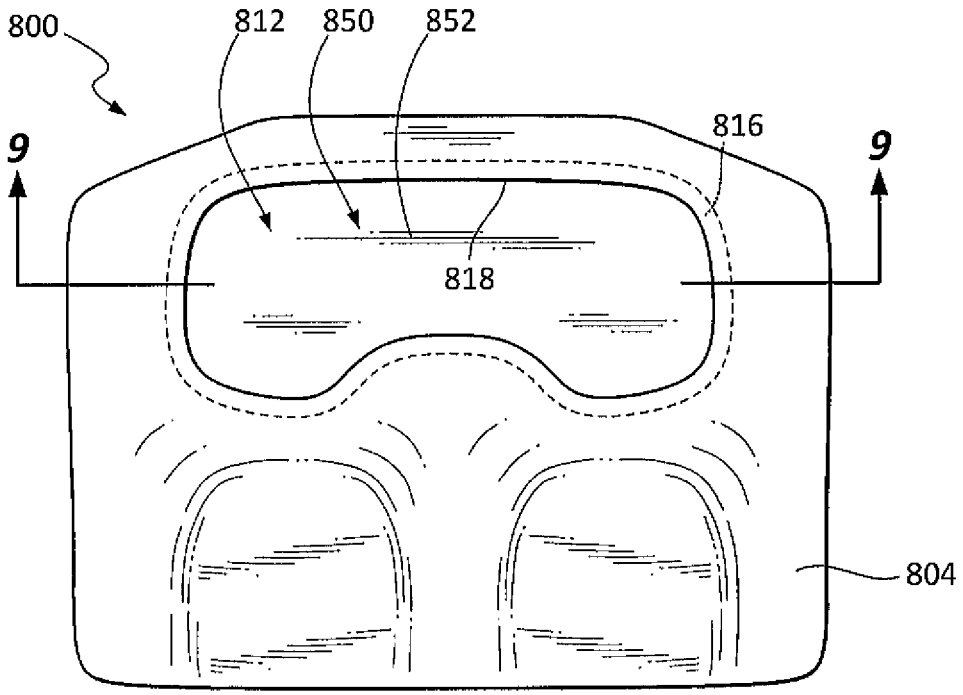
FIG. 8 is a top plan view of a cushion base for a hybrid cushion for seating according to an embodiment of the present disclosure.
Figure 9:
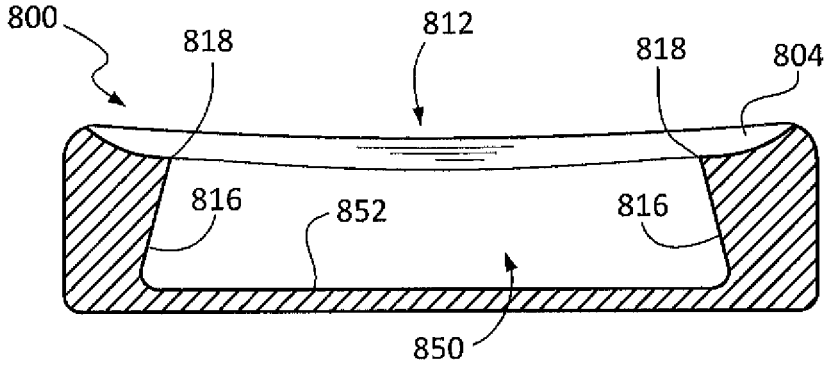
FIG. 9 is a cross-section view of the cushion base shown in FIG. 8 taken along cross-section indicators 9-9.

FIG. 3 is a top plan view of a cushion base 202 according to an embodiment of the present disclosure. The cushion insert 220 is not shown in FIG. 3. The outer sides 206 of the cushion base 202 and the wide perimeter 302 of the lower portion of the void 214 sidewall 216 are shown. The void 214 in this embodiment is shown as a through-hole or aperture that extends through the entire thickness of the cushion base 202. In other embodiments, the void 214 may extend partially through the cushion base 202, such as is shown in FIGS. 8-9.

Additionally, there is only one void 214 shown in FIG. 3, but in other embodiments, multiple voids may be formed in the cushion base 202. Multiple voids may be beneficial to provide different bladder inserts at different portions of the cushion base 202 (e.g., multiple cushion inserts having various levels of internal pressure or fill materials) or to allow the cushion base 202 material to provide additional support to areas between multiple cushion inserts. The void 214 has an opening 212 at the seating surface 204 and underneath the cushion base 202. In other embodiments, the void 214 may comprise a passage through the cushion base 202 having multiple openings in a single surface. For example, the void 214 may have two openings in the seating surface that are connected by a passage within the cushion base 202.

FIG. 4 is a section view of the cushion base 202 of FIG. 3 taken along section lines 4-4 in FIG. 3. FIG. 4 shows the reverse taper of the sidewall 216 of the void 214, where the sidewall 216 is at an angle 230 with respect to a vertical. In some embodiments, the angle 230 is between greater than 0 degrees and about 45 degrees. In other embodiments, the angle 230 may beneficially be between greater than 0 degrees and about 20 degrees. The lip edge 218 in this figure is shown pointed, but it may be chamfered, filleted, rounded, or take another transition shape, as described above. In some embodiments, the lip edge 218 overhangs a portion of the void 214 such that at least a portion of the sidewall 216 is wider than the lip edge 218. For example, FIGS. 3 and 4 show that the wide perimeter 302 at the bottom edge of the sidewall 216 is wider than the lip edge 218. Thus, when a cushion insert (not shown) is positioned in the void 214, the lip edge 218 and sidewall 216 may be between the seating surface 204 and the outer edge or sides of the insert.

Figure 5A:
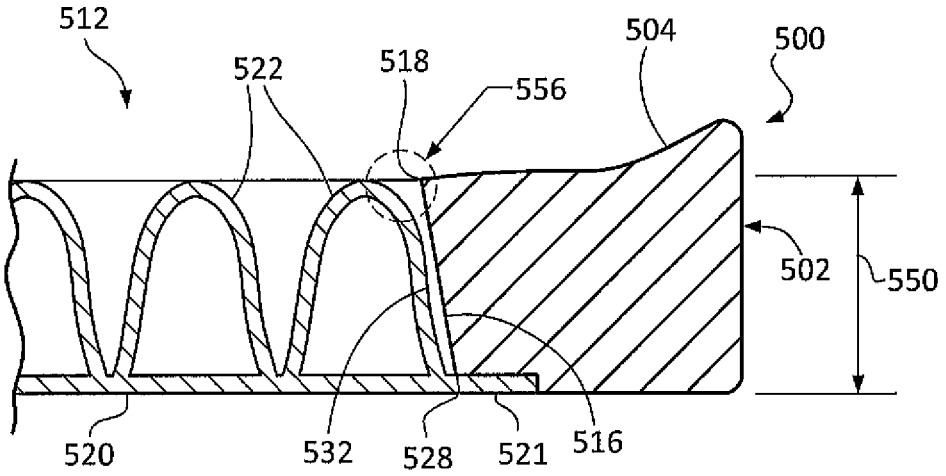
FIG. 5A is a cross-section view of a portion of a hybrid cushion for seating having a filled cushion insert according to an embodiment of the present disclosure.
Figure 5B:
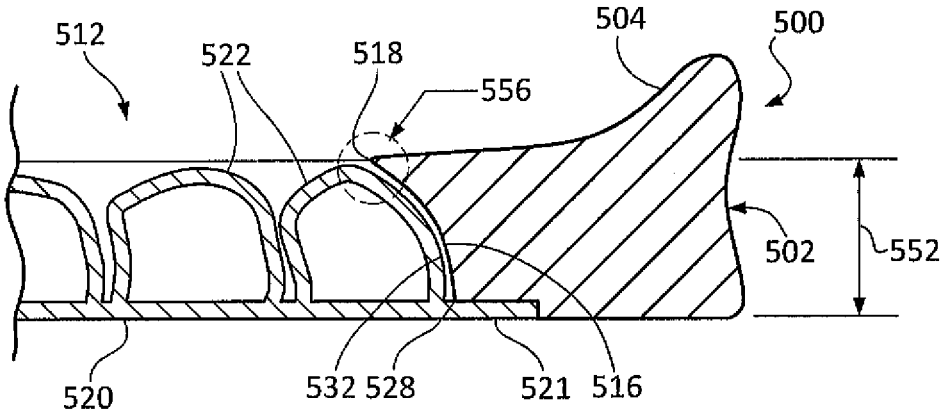
FIG. 5B is a cross-section view of the portion of a hybrid cushion for seating shown in FIG. 5A having a partially-filled cushion insert.
Figure 5C:
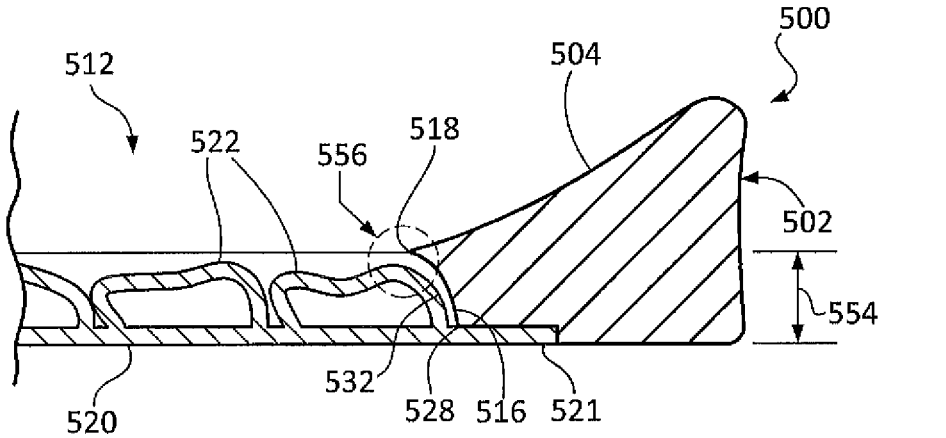
FIG. 5C is a partial side section view of the portion of a hybrid cushion for seating shown in FIG. 5A having a fully-emptied cushion insert.

FIGS. 5A-5C show an exemplary embodiment of a hybrid cushion for seating under various levels of compression. FIG. 5A shows an uncompressed hybrid seat cushion 500 with a filled cushion insert 520, FIG. 5B shows a partially compressed hybrid seat cushion 500 with a partially emptied insert 520, and FIG. 5C shows a deeply compressed hybrid seat cushion 500 with a significantly emptied insert 520. Thus, three fill levels of the cushion inserts 520 are shown. A cushion base 502 is shown attached to the cushion insert 520 in each instance. The cushion base 502 may have a seating surface 504 on an upward-facing portion of the base. A through-hole or aperture 512 may extend through the thickness of the cushion base 502. A cushion insert 520 is positioned in the aperture 512. The cushion insert 520 may include multiple connected fluid-bearing partitions 522 which may or may not be in fluid communication with each other, as described in connection with the partitions 222 of FIG. 2. The cushion insert 520 may have an outer edge portion 521 attached to the cushion base 502 on a portion of the cushion base 502 opposite the seating surface 504. The aperture 512 of the cushion base 502 includes a sidewall 516 and a pointed lip 518. The sidewall 516 is adjacent to the side surface 532 of a partition 522 of the cushion insert 520. The sidewall 516 may be angled or tapered as shown such that the lip 518 is above at least a portion of the side surface 532 of partition 522.

In FIG. 5A, the height 550 of the cushion base 502 is uncompressed. In this uncompressed state, the lip 518 may be essentially in-plane with the top of the partitions 522 when the partitions 522 are fully filled or inflated. The sidewall 516 tapers outward from the lip 518 to the lower perimeter 528 of the aperture 512 in the cushion base 502 in a direction from a central point on the cushion base 502 toward an outer periphery of the cushion base 502. This relationship between the cushion base 502 and the cushion insert 520 may provide many benefits to the operation and use of the hybrid cushion 500. For example, the even height of the partitions 522 and seating surface 504 may allow covers and top-cushions to be easily installed around the cushion 500 without interference of bulges or indentations in the general top surface of the cushion 500. Further, the transition area 556 between the cushion insert 520 and the cushion base 502 is small, minimizing the negative effects of large openings or spaces between the cushion base 502 and the cushion insert 520. Additionally, the outer edge portion 521 of the cushion insert 520 is not adjacent to the seating surface 504, so a seated user is much less likely to be able to feel any effects from potential rippling, bending, or ridges in the edge portion 521. Such deformities in the outer edge portion 521 may be dampened or absorbed by deflection of the cushion base 502.

In FIG. 5B, the cushion base 502 is partially compressed, as shown by reduced height 552. Thus, the cushion base 502 may have a reduced height 552 where a user is seated. The partitions 522 of the cushion insert 520 are partially deflated or emptied. Under pressure on the seating surface 504, the lip 518 and sidewall 516 of the cushion base 502 deflect inwardly toward the upper opening of the aperture 512 due to being angled in their uncompressed state (e.g., as shown in FIG. 5A). They are predisposed to move in that direction starting from their uncompressed state. While under compression, the lip 518 is driven downward and inward over a top portion of the partially deflated cushion insert 520. Thus, even with pressure applied to the seating surface 504, the transition area 556 may be small, and may even be reduced or unchanged from the configuration of FIG. 5A, despite the deflation of the cushion insert 520.

With a roughly consistent size of transition area 556 across multiple fill levels of the cushion insert 520, the user may receive a relatively consistent, predictable feel and level of comfort while still being able to adjust the fill of the cushion insert 520 to provide a customized amount of cushion feedback. In some embodiments, the lip 518 may be driven into contact with the side surface 532 of a partition 522, thereby reducing the transition area 556 even more.

The outer edge portion 521 in FIG. 5B of the cushion insert 520 remains set off from the seating surface 504, providing a buffer between the user and the potential discomfort of contact with the edge portion 521.

FIG. 5C shows the cushion base 502 deeply compressed, as shown by reduced height 554. The cushion insert 520 is also even more emptied in comparison to FIGS. 5A and 5B. Again, the lip 518 and sidewall 516 of the cushion base 502 may deflect inward toward the opening of the aperture 512. The transition area 556 is still generally consistent in size with FIGS. 5A and 5B, even though the shape of the cushion base 502 and the shape of the cushion insert 520 have changed dramatically. The transition area 556 is filled with a combination of the cushion insert 520 and the cushion base 502, as in previous examples and embodiments.

The outer edge portion 521 in FIG. 5C of the cushion insert 520 remains set off from the seating surface 504, providing a buffer between the user and the potential discomfort of contact with the edge portion 521.

Figure 6A:
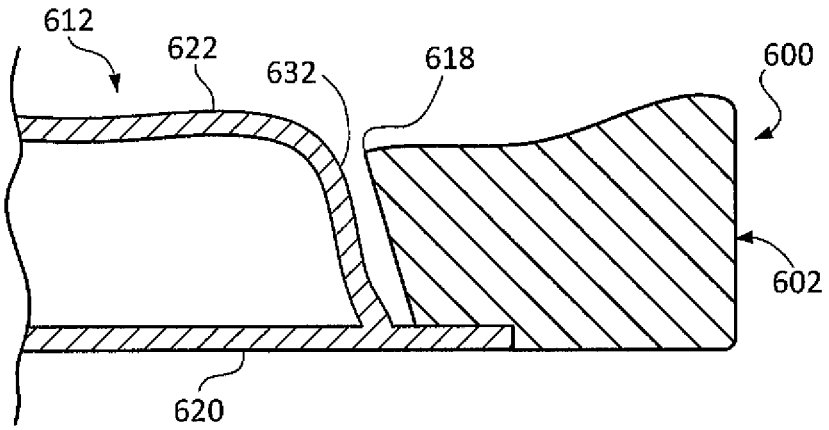
FIG. 6A is a cross-section view of a portion of a hybrid cushion for seating having a single, fully-filled pocket cushion insert according to an embodiment of the present disclosure.

FIG. 6A shows a cross-section view of a portion of a hybrid cushion 600. A single pocket 622 is shown in the cushion insert 620 positioned in the aperture 612 of the cushion base 602. The cushion base 602 is not compressed. The pocket 622 may be filled with a fluid, such as, for example, a gas, gel, or liquid, as described in more detail in relation to bladders and other cushion inserts above. The lip 618 of the upper opening of the aperture 612 is lower than the top of the pocket 622 of the insert 620 relative to the bottom of the hybrid cushion, but still lies over at least a lower portion 632 of the side of the pocket 622. An upper portion 634 of the side of the pocket is not positioned below the lip 618. Regardless, when a user is seated on the hybrid cushion 600, deflection of the cushion base 602 will still drive the lip 618 into or nearer to the pocket 622, reducing or preserving the size of a transition area 636 between the base 602 and the insert 620.

Figure 6B:
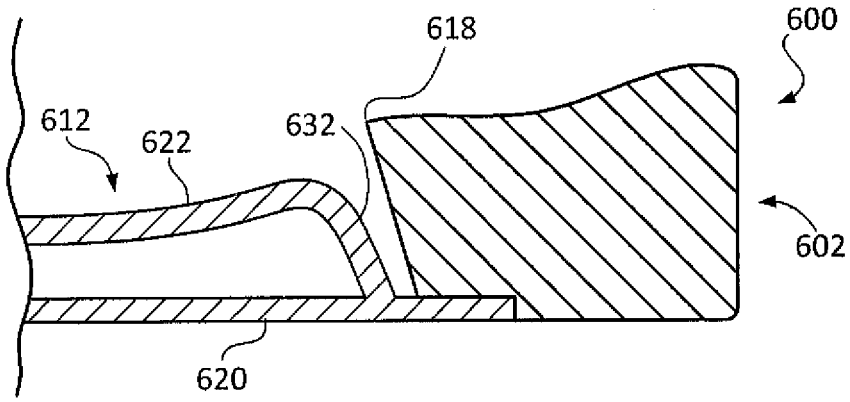
FIG. 6B is a cross-section view of the portion of a hybrid cushion for seating shown in FIG. 6A having a partially-filled cushion insert.

FIG. 6B shows a cross-section view of a portion of the hybrid cushion 600 of FIG. 6A where the single pocket 622 is partially deflated and the cushion base 602 is uncompressed. Lip 618 of the cushion base 602 now overhangs both portions 632, 634 of the side of the pocket 622. In this configuration, a seated user may still compress the cushion base 602, thereby driving the lip 618 into contact or near to the portion 634 on the side of the pocket 622. The transition area in this case would be substantially similar in size to transition area 636 of FIG. 6A since the cushion insert 620 is at least partially underneath the lip 618. The relative height of the lip 618 in an uncompressed position and the top of the pocket 622 of the cushion insert 620 in an uncompressed position may have little effect on the performance of the cushion (as measured by effect on the transition area (e.g., transition area 636)).

FIG. 6B shows an exemplary view of how a cushion base 602 may appear in relation to a partially-deflated cushion insert 620 when the cushion base 602 is not subject to downward surface pressure (e.g., the weight of a seated user). In contrast, previous FIGS. 5B and 5C show the cushion base 502 under compression. In FIG. 6B, the lip 618 may be relatively farther from the side of the cushion insert 620 (e.g., upper portion 634) in the uncompressed position, for example, in comparison to the compressed lip 518 and side 532 of the hybrid cushion 500 of FIG. 5C. Thus, FIG. 6B may illustrate that, for purposes of comparing one transition area to another (e.g., when comparing the size of transition area 556 to the size of transition area 636), the size and features of a transition area of a hybrid cushion are to be determined when the cushion base 602 is subjected to typical downward surface pressure loading conditions. For example, to determine characteristics of the transition area of the hybrid cushion 600 in FIG. 6B, the cushion base 602 may be compressed, driving the lip 618 on the cushion base 602 and the surfaces of the cushion insert 620 into the positions they normally assume while under a typical load, and the area of transition between the cushion insert 620 and cushion base 602 may then be examined.

This method of examining the transition area may be beneficial because cushion elements (e.g., insert 620 or base 602) may have significantly differing geometries based on the flexibility of the materials of which they are comprised. For example, a cushion base 602 may be much thicker in an uncompressed state when it is comprised of a viscoelastic foam than a cushion base 602 comprised of a relatively rigid bonded urethane foam, but when these cushion bases 602 are each under a typical load, their compressed thicknesses may be identical. Therefore, the transition areas of each of the bases 602 may be identical, so it may be preferable to examine the transition area of each base 602 when under load to get an accurate understanding of how the transition area would affect the comfort of a seated user.

Figure 7A:
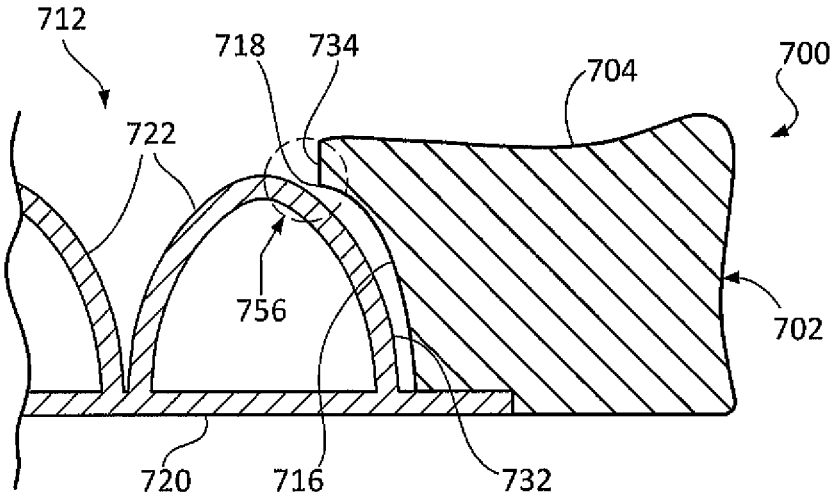
FIG. 7A is a cross-section view of a portion of a hybrid cushion for seating according to an embodiment of the present disclosure.

FIG. 7A shows an embodiment of a hybrid cushion 700 having an alternative configuration of the lip 718 and sidewall 716 of a cushion base 702. The cushion base 702 is uncompressed, and the cushion insert 720 is fully inflated and positioned in the aperture 712 in the cushion base 702. The seating surface 704 may be separated from the lip 718 by a transition surface 734. The transition surface 734 may be a generally vertical offset between the lip 718 and the seating surface 704, as shown, or may be tapered. For example, the transition surface 734 may be sloped downward, sloped upward, curved, beveled, stepped, or take another shape transitioning between the seating surface 704 and the lip 718. In this manner, the shape of the cushion base 702 is configurable to prevent unnecessary pinching of the user or other materials on top of the seating surface between the lip 718 and a partition 722 of the insert 720. In some embodiments, the transition surface 734 is omitted, so the lip 718 is directly at the seating surface 704. In other embodiments, the lip 718 is rounded and defined as either the tip of the rounded surface or a point below the tip where the top of the aperture 712 transitions into the sidewall 716.

Figure 7B:
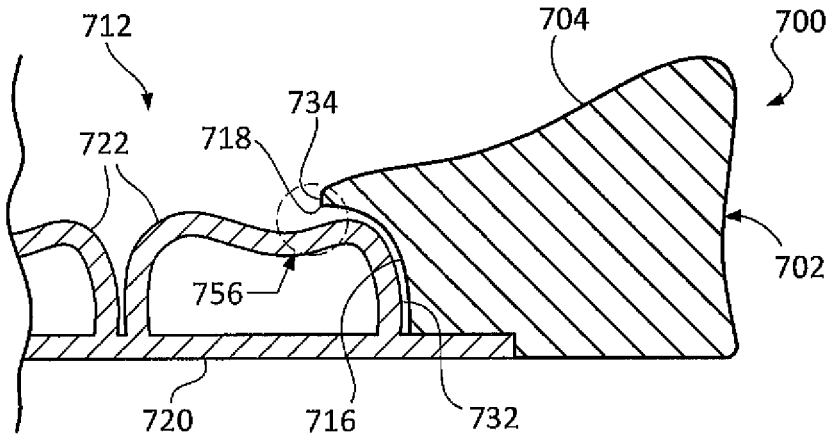
FIG. 7B is a cross-section view of the portion of a hybrid cushion shown in FIG. 7A for seating having a significantly-emptied cushion insert.

The sidewall 716 of the aperture 712 may be concave, thereby potentially more closely following the shape of an insert 720 as it is deformed by filling or emptying. For example, the curved sidewall 716 of hybrid cushion 700 shown in FIG. 7B closely follows the curved side surface 732 of the insert 720. This may affect the lateral inward deflection of the lip 718 in comparison to a sidewall 716 that is straight and sloped. This property is illustrated in the lateral inward deflection of lip 518 across FIGS. 5A and 5B when compared to the deflection of lip 718 across FIGS. 7A and 7B. Differences in deflection of the lip 718 may reduce wear on the foam cushion base 702 due to different levels of stretching of the seating surface 704 as the lip 718 and side of the insert 720 collapse into the transition area 756 when under pressure. Additionally, a concave sidewall provides less support below the lip 718 than a comparable angled surface (e.g., sidewall 516 shown in FIGS. 5A-5C), so the transition area around the lip 718 may be more flexible and collapsible into the insert 720. This flexibility and collapsibility are variable characteristics that may be designed for optimal comfort of the hybrid cushion at the transition area 756.

In some arrangements, the curved sidewall 716 perpendicularly intersects the bottom of the cushion base 702. In some arrangements, the sidewall 716 intersects the bottom of the cushion base at an angle (e.g., an angle complementary to the angle 402 shown in FIG. 4). Thus, the curved surface 716 may have a plurality of radii of curvature, including an infinite radius of curvature. For example, infinite curvature may be present when the curve turns into a flat plane at the bottom intersection point or where the sidewall 716 meets the lip 718.

FIG. 8 is a top plan view of a cushion base 800 according to another embodiment. FIG. 9 is a cross-section view of the cushion base 800 taken along section lines 9-9 shown in FIG. 8. The cushion base 800 has a contoured opening 812 in its seating surface 804. The space below the opening 812 does not extend entirely through the thickness of the cushion base 800, resulting in a cavity 850 in the cushion base 800 (see FIG. 9). The cavity 850 may have a bottom surface 852 and sidewalls 816. The bottom surface 852 of the cavity 850 in the cushion base 800 may be formed as an integral part of the cushion base 800 or it may be formed by attaching or gluing a sheet of material to the bottom of the cushion base 800 to form the cavity 850. This sheet of material may be made of a variety of materials, including but not limited to foam, fabric, wood, metal, or plastic. In one embodiment, a foam cushion is provided having a thru-hole formed in the cushion to create a cavity, with a piece of fabric secured to the bottom of the foam cushion base. The sidewalls 816 may be angled outward from a lip 818 at the seating surface 804 to the bottom surface 852, so that the bottom surface 852 spans an area wider than the lip 818 at the opening 812 for at least some portions of the cushion base 800. In some arrangements, the sidewalls 816 may be concave or curved, as discussed in connection with sidewalls 716 of FIGS. 7A-7C above.

In some embodiments, a cushion insert (not shown in FIG. 8 or 9) may be positioned in the cavity 850. For example, the insert may be attached to or placed on the bottom surface 852. The cushion insert may be beneficially shaped to have outer side wall portions lying at least partially under the sidewalls 816, such that the lip 818 lies above at least a portion of the outer side portions of the insert when the insert is within the cavity 850 and the cushion base 800 is uncompressed. Benefits and specifications of the positioning of these elements are discussed in more detail above.

In another embodiment, a method of manufacturing a hybrid seating cushion may be provided. The hybrid seating cushion produced may be one of the hybrid cushions 200, 500, 600, 700, 800 described in connection with FIGS. 2-9. In one configuration, the method includes providing a cushion base and a bladder. The cushion base may have a seating surface, and the bladder may have an outer wall, similar to the elements previously described in connection with FIGS. 2-9. The cushion base may be a cushion suitable for use as a cushion for seating and comprise foam rubber or another similar material. The bladder may be a flexible cushion insert, sack, or other gel-, fluid-, or gas-bearing element capable of generally evenly distributing pressure on its top seating surface. The bladder may also comprise a plurality of separate cells or partitions which may or may not allow fluid flow between each other, as discussed above.

The method may further include forming an opening in the seating surface of the cushion base. For example, the opening may be carved from or cut out of a solid foam cushion base. In some arrangements, the cushion base may be pre-formed with a void fulfilling the requisite functions of the openings described above (see, e.g., opening 812 and openings for apertures 212, 512, 612, 712). In yet other embodiments, an aperture or cavity in the cushion base may be pre-formed or cut into the cushion base, and the step of forming an opening in the seating surface may require refining or modifying the dimensions or proportions of the pre-formed opening to receive the bladder according to the bladder thickness, width, and other dimensions.

The opening may define a lip edge which runs around at least a portion of the opening in the seating surface. In some embodiments, the lip edge may be at the intersection of a sidewall of the cavity or aperture in the cushion base and the seating surface. A plane of the interior sidewall and a plane of the seating surface may be formed to intersect at an angle of less than 90 degrees. In another embodiment, the planes may intersect at an angle in the range between about 45 degrees and less than 90 degrees. In yet another embodiment, the planes may intersect at an angle in the range between about 70 degrees and less than 90 degrees. For example, the planes of the sidewall and the seating surface may intersect at the lip edge at an angle of less than 90 degrees, thereby forming a point directed inward toward the opening in the cushion base (e.g., at least when viewed in cross section). In another example, the seating surface and the sidewall of the cavity or aperture through the cushion base may not directly intersect at the lip edge (see, e.g., FIG. 7A) but at least a portion of the sidewall and seating surface form planes intersecting at an angle less than 90 degrees.

The opening may be sufficiently sized to receive at least a portion of the bladder. For example, the opening may be formed having a similar general shape and size as the outer portions of the bladder, such as a rectangular (or other shape) opening to receive a generally rectangular (or other corresponding shape) bladder. In embodiments having a cavity formed in the cushion base that does not extend completely through the thickness of the cushion base, the opening may need to have a depth sufficient to allow the bladder to be reached by the user's body when seated on the cushion and sufficient to allow at least a portion of the outer area of the bladder to be underneath the lip edge of the opening when the bladder is positioned in the opening. In some embodiments, it may be beneficial to form the opening in the seating surface so that when the bladder is positioned in the opening, the outer perimeter of the top of the bladder is followed closely in parallel by the lip edge, thereby reducing the size of the transition area between the cushion base and inserted bladder materials.

The method may also include positioning a bladder within the opening. For example, this step may comprise attaching the bladder to the cushion base so that at least a portion of the bladder is within the opening in the seating surface. The bladder may be glued to the cushion base. It may alternatively (or in addition) be stapled, sewn, attached by buttons, snaps, hook-and-loop fastener material, or secured to the cushion base by another removable or permanent attachment or fastening means. In some configurations, the bladder may be attached to a bottom surface of the cushion base, as shown, for example, in FIG. 5A. In other cases the bladder may be alternatively (or additionally) attached to an internal surface of a cavity (e.g., to surface 852 shown in FIG. 9) or to a side wall of the cavity or aperture (e.g., to sidewalls 816 or 516). The bladder may also be referred to as attaching generally to a lower surface of the cushion base, such as being attached to a bottom surface of the cushion base, a surface near the bottom end of the aperture or cavity in the cushion base, another surface below the seating surface, or a surface that would not contact the user when he or she is seated on the cushion. In some embodiments, the bladder comprises an attachment surface or extension configured for connection to the cushion base. For example, the bladder may comprise an outer edge portion (e.g., outer edge portion 521 of FIGS. 5A-5C).

Upon positioning the bladder in the opening, at least a portion of the outer wall of the bladder may be positioned under the lip edge of the cushion base. This may result in the lip edge being compressible into or toward the bladder when a user is located on the seating surface. This relationship between the cushion base and the bladder may provide a minimal transition area or zone between the seating surface of the cushion base and the seating surface of the bladder. It may also minimize the change in size or shape of the transition area when the bladder is partially or completely emptied.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

The preceding description has been presented only to illustrate and describe embodiments of the principles described herein. It is not intended to be exhaustive or to limit the disclosure to any precise form disclosed. While this disclosure has been made with reference to certain specific embodiments and examples, it will be recognized by those skilled in the art that many variations are possible without departing from the scope and spirit of this specification. The scope of the invention, as defined by the claims and disclosure, is intended to include all changes and modifications which do not depart from the spirit of the specification, including the claims. The words "including" and "having," as used in the specification, including the claims, shall have the same meaning as the word "comprising."

What is claimed is:

1. A hybrid seating cushion, comprising:

a cushion base having a seating surface, the seating surface having a lip edge extending along an upper perimeter of and overhanging a void in the cushion base;

the void having a top surface defining the upper perimeter, a bottom surface defining a lower perimeter, and a sidewall extending between the top surface and the bottom surface and along both perimeters, the void extending completely through the cushion base from the seating surface to the bottom surface;

the sidewall having a linear reverse taper such that a width of the void at the lip edge and the top surface is smaller than a width of the void at the bottom surface;

a bladder configured to support at least one of an ischial tuberosity, a coccyx, and a sacral area of a user, the bladder being positioned in the void and having an outer wall extending at least partially under the lip edge, wherein the sidewall is configured to be pressed into contact with at least a portion of the outer wall of the bladder;

and the seating surface further having at least one contoured region configured to receive and support at least one leg of the user, the at least one contoured region being completely located outside of the upper perimeter of the void.

2. The hybrid seating cushion of claim 1, wherein the bladder further comprises a plurality of at least partially separate cells.

3. The hybrid seating cushion of claim 2, wherein the plurality of at least partially separate cells are interconnected by a plurality of pressure-distributing passages.

4. The hybrid seating cushion of claim 1, wherein the lip edge is pointed inward in relation to an opening of the void.

5. The hybrid seating cushion of claim 1, wherein the lip edge at least partially forms a transition surface between the sidewall of the void and the seating surface.

6. A hybrid seating cushion, comprising:

a cushion base having a seating surface, the seating surface having a lip edge extending along an upper perimeter of and overhanging a void in the cushion base;

the void having a top surface defining the upper perimeter, a bottom surface defining a lower perimeter, and a sidewall extending between the top surface and the bottom surface and along both perimeters, the void extending completely through the cushion base from the seating surface to the bottom surface;

the lower perimeter being greater than the upper perimeter such that said sidewall is angled;

a bladder configured to support at least one of an ischial tuberosity, a coccyx, and a sacral area of a user, the bladder being positioned in the void and having an outer wall extending at least partially under the lip edge, wherein the sidewall is configured to be pressed into contact with at least a portion of the outer wall of the bladder;

and the seating surface further having at least one contoured region configured to receive and support at least one leg of the user, the at least one contoured region being completely located outside of the upper perimeter of the void.

* * * * *